US005396871A

United States Patent [19]

Faupel et al.

[11] Patent Number: 5,396,871

[45] Date of Patent: Mar. 14, 1995

[54] FUEL INJECTION PUMP FOR INTERNAL COMBUSTION ENGINES

[75] Inventors: Werner Faupel, Gerlingen; Dieter Heck, Rutesheim; Dieter Seher, Ilsfeld, all of Germany

[73] Assignee: Robert Bosch GmbH, Stuttgart, Germany

[21] Appl. No.: 211,527

[22] PCT Filed: Jul. 21, 1993

[86] PCT No.: PCT/DE93/00641

§ 371 Date: Apr. 5, 1994

§ 102(e) Date: Apr. 5, 1994

[87] PCT Pub. No.: WO94/03722

PCT Pub. Date: Feb. 17, 1994

[30] Foreign Application Priority Data

Aug. 5, 1992 [DE] Germany ..... 42 25 803.0

[51] Int. Cl.[6] ..... F02M 37/04; F02B 7/04

[52] U.S. Cl. ..... 123/500; 123/501; 417/494; 417/499

[58] Field of Search ..... 123/500, 501, 503, 449; 417/494, 499

[56] References Cited

U.S. PATENT DOCUMENTS

| | | | |
|---|---|---|---|
| 1,926,743 | 9/1933 | Hill | 123/501 |
| 1,966,694 | 7/1934 | Vaudet | 123/501 |
| 2,159,177 | 5/1939 | Ricardo | 123/501 |
| 2,575,955 | 11/1951 | Hatch | 417/494 |
| 2,810,375 | 10/1957 | Froehlich | 123/500 |
| 4,013,055 | 3/1977 | Sommer | 123/500 |
| 4,757,794 | 7/1988 | Hofer | 417/494 |
| 4,975,029 | 12/1990 | Hatz | 417/494 |
| 5,097,812 | 3/1992 | Aogostin | 123/500 |
| 5,135,367 | 8/1992 | Finsterwalder | 417/499 |
| 5,219,280 | 6/1993 | Yashiro | 123/500 |

FOREIGN PATENT DOCUMENTS

| | | | |
|---|---|---|---|
| 0071896 | 2/1983 | European Pat. Off. | 123/500 |
| 788268 | 10/1935 | France | 123/501 |
| 963294 | 7/1950 | France | 123/500 |
| 311727 | 11/1973 | Germany | 123/501 |
| 20 45 556 | 10/1979 | Germany | 123/501 |
| 0215124 | 10/1984 | Germany | 123/501 |

*Primary Examiner*—Carl S. Miller

*Attorney, Agent, or Firm*—Edwin E. Greigg; Ronald E. Greigg

[57] ABSTRACT

A fuel injection pump for internal combustion engines, having a pump piston that moves in a cylinder liner and defines a pump work chamber with the cylinder. The piston has two control edges that cooperate with a control opening in the cylinder liner. One, control edge is oblique, disposed on the jacket face and communicates continuously with the pump work chamber which controls the end of supply. A first upper control edge formed by the face end of the pump piston, controls the supply onset upon overtaking the control opening. For a load- and temperature-dependent shift of the supply onset toward early, the face end of the pump piston has a first region (B), axially indented in the direction of the cam drive, forming a second control edge, which is separated from the flat region (A) on the face end by a longitudinal groove and in the first region a second region (C), indented via shoulders is disposed in turn in the direction of the cam drive, with a third control edge.

16 Claims, 3 Drawing Sheets

FUEL INJECTION PUMP FOR INTERNAL COMBUSTION ENGINES

PRIOR ART

The invention is based on a fuel injection pump as defined hereinafter. In one such fuel injection pump, known from German Patent Disclosure DE-OS 2 246 056, in which a pump piston whose end face defines a pump work chamber is moved axially in a cylinder liner, the control edge on the face end of the pump piston, which edge by overtaking a control opening disposed in the cylinder wall controls the injection onset, is slanted relative to the control opening. In the rotary positional range of the pump piston that controls the rated load range of the internal combustion engine to be supplied, in such a way that the injection onset in this range is delayed in the direction of a later onset. This makes it possible not only to optimize the injection onset for the high-load range but also to achieve a high maximum combustion pressure in the pump work chamber in the other operating points as well, because these points can now be adapted independently of the rated load range. With the known fuel injection pump, it is thus possible to increase the maximum combustion pressure over the entire operating range of the fuel injection pump, without exceeding the maximum allowable limit value for the mechanical loadability of the components.

In designing the known fuel injection pump for emission-optimized engines, however, the injection onsets must be shifted to so late that in the cold state of the engine in the lowermost load range, or at zero load, white smoke is emitted, which in that operating state increases the pollutant emissions of the engine to be supplied.

ADVANTAGES OF THE INVENTION

The fuel injection pump according to the invention has the advantage over the prior art that by the design of the pump piston control edge that controls the supply onset and hence the injection onset, with indented regions, a shift of the supply onset to early is performed at zero or low load and as a function of the temperature, and as a result white smoke in the warmup phase of the engine can be avoided without requiring an additional external injection timer for that purpose.

By embodying the control edges with a specific shape to form two regions, so that for the operating range involving the cold engine operated at low or zero load, a control region with an extreme shift toward early takes effect, while at higher load or temperature the shift toward early of the supply onset is less extensive, because of the other control region. In this way it is possible to vary the extent of the shift toward early above all in the idling mode as a function of the operating temperature and load of the engine, and thus to adjust the optimal supply onset for the various operating ranges. Another advantage is attained by separating the control edges from one another by means of a longitudinal groove; thus both control edge regions are separated exactly from one another, which enables proper association of a separate pump performance graph. The abrupt transition from control edge to control edge via axially parallel edges has the further advantage, in the fuel injection pump according to the invention that the individual governing locations can be rapidly triggered by discontinuity functions, so that an accurate association with the various governing ranges is possible.

A further advantage is attained in that the switchover between the control edge regions and thus between the pump performance graphs takes place as a function of temperature and load in electrically governed fuel injection pumps via a simple logic circuit, which moreover takes into account the hysteresis occurring in the governing cycle, resulting in not only less expense for control, but also high flexibility in terms of the limit value specifications.

Further advantages and advantageous features of the subject of the invention may be learned from the drawing, description and claims.

DRAWING

An exemplary embodiment of the subject of the invention is shown in the drawing and will be described in detail below.

DESCRIPTION OF THE EXEMPLARY EMBODIMENT

Figure 1:
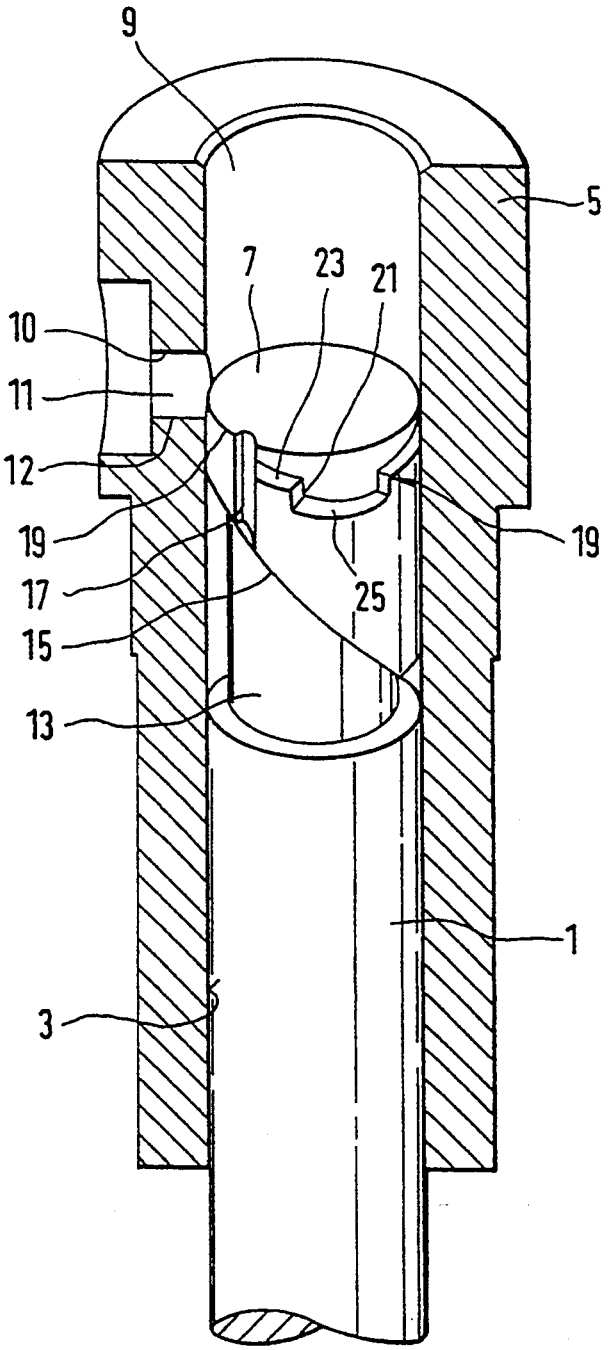
FIG. 1 shows a detail of the fuel injection pump according to the invention.

In the fuel injection pump, of which only the portion essential to the invention is shown in FIG. 1, a pump piston 1 is moved axially back and forth by a cam drive, not shown in a cylinder bore 3 of a cylinder liner 5 inserted into a pump housing. In the process, the pump piston 1, with its face end 7 remote from the cam drive, defines a pump work chamber 9 in the cylinder bore 3 that during a portion of the piston stroke communicates through a radial control opening 11 with a fuel-filled low-pressure chamber surrounding the cylinder liner 5. The radial control opening 11, with its outlet edge in the direction of the pump piston longitudinal axis, defines one upper control edge 10 and one lower control edge 12, which cooperate with the pump piston 1. For the sake of injection control, the pump piston is rotatable via a governor rod, likewise not shown, and on its jacket face it has a control recess 13 that cooperates with the control opening 11 and is defined on the side toward the pump work chamber by an oblique control edge 15 and communicates continuously with the pump work chamber 9 via a longitudinal groove 17. The edge created at the transition of the face end 7 to the jacket face of the pump piston 1 forms an upper first control edge 19 on the pump piston 1, which in cooperation with the control opening 11 in the cylinder liner 5 controls the supply onset and hence the injection onset as well.

Figure 2:
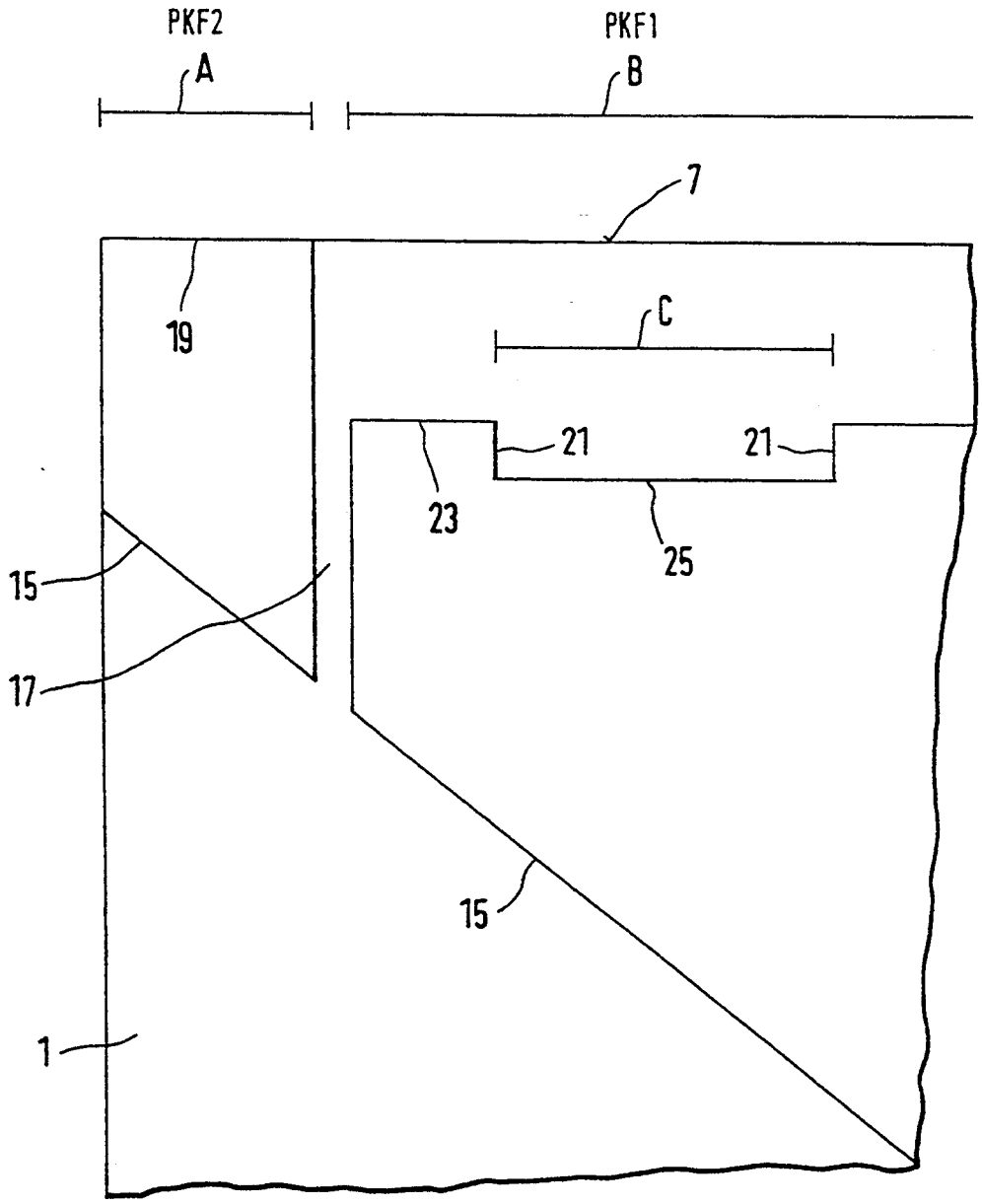
FIG. 2 is a developed view of the pump piston that shows the embodiment of the control edges.

Also according to the invention, the pump piston 1 has a first and second indented region, with a second control edge 23 and a third control edge 25, which are separated from the first control edge 19 by the longitudinal groove 17. As shown in the developed view of the pump piston 1 in FIG. 2, a first region A is formed by the flat course of the face end 7 with the first control edge 19, which is maximally spaced apart from the end of the pump piston 1 toward the cam drive. the second region B, separated from the region A by the longitudinal groove 17, is set back in the direction of the cam drive relative to the face end 7 and forms a first recess, which is defined in the direction of the cam drive by the second control edge 23 and which in turn has still another region C that is set back or indented in the direction of the cam drive and that there forms a second recess with the third control edge 25. The control edge transitions between the various regions are embodied in the form of shoulders 21, so that by means of these axially parallel transitions the various governing locations are triggered by discontinuity functions and an unequivocal association of the respective region is possible.

Various pump performance graphs, which cover various operating ranges of the engine to be supplied, are associated with the regions A and B separated from one another by the longitudinal groove 17. Thus a pump performance graph 2 that controls the operation of the cold engine at low or zero load is associated with region A, and the remaining operating range of the warm engine or the engine operated at higher load is associated with region B, which includes region C.

The slope of the oblique control edge 15 that controls the end of the supply and hence the injection quantity is the same over its entire length; that is, the highest fuel supply quantity is attained in region C at its end remote from the longitudinal groove 17; this setting is associated approximately with the full-load range of the engine to be supplied.

Figure 4:
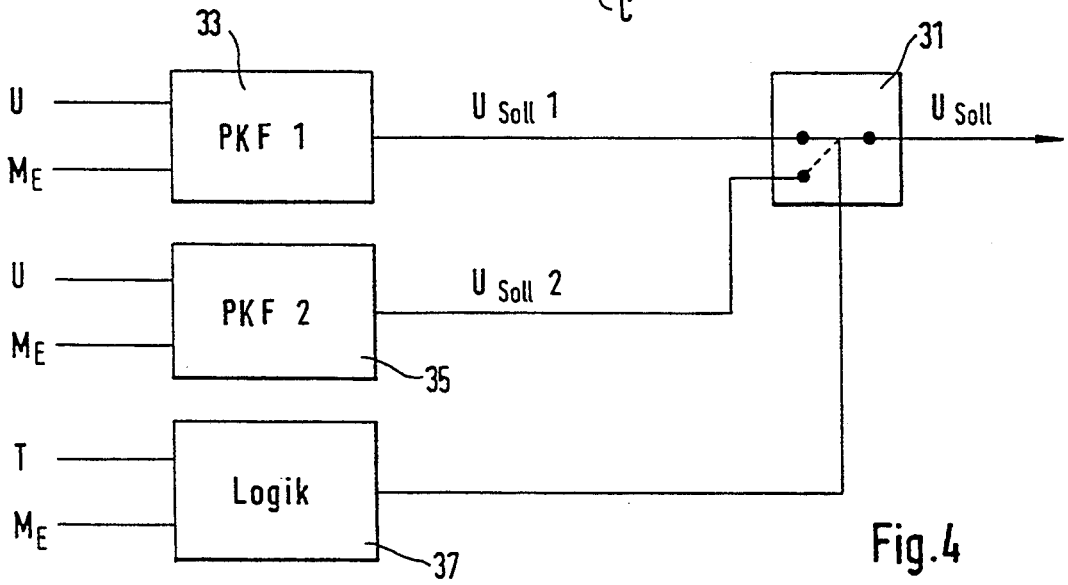
FIG. 4 is a schematic illustration of the electronic triggering of the governing mechanism by a logic circuit.
Figure 5:
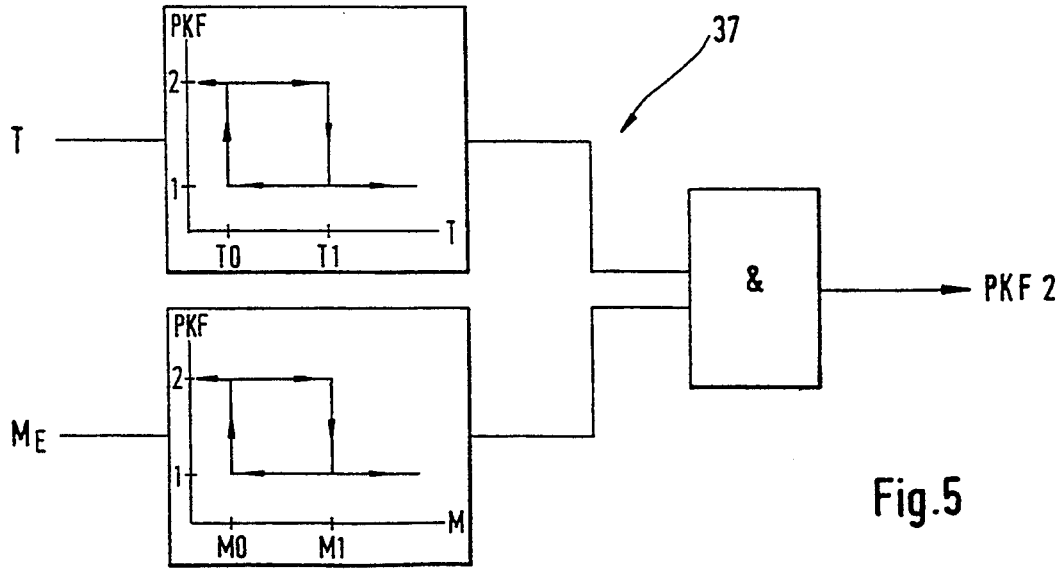
FIG. 5 is a schematic illustration of the logic circuit of FIG. 4.

The adjustment of the rotational position of the pump piston 1 relative to the cylinder liner 5 is done, as already mentioned, by the governor rod and an electronically triggered governing mechanism, which as shown in FIGS. 4 and 5 includes a simple logic circuit, which processes the various operating variables of the engine to be supplied, such as the temperature and the desired fuel quantities, and triggers the regions or pump performance graphs.

To that end, the circuit as shown in FIG. 4 comprises a changeover switch 31, which is connected to the electronic governing mechanism for governing the injection quantity and which as input or control variables can be connected either-to a first electronic control unit 33, which controls the adjustment of the governing mechanism as a function of the rpm and the required quantity in accordance with a first pump performance graph (PKF 1), or with a second electronic control unit 35, which triggers the governing mechanism as a function of the rpm and the desired fuel quantity in accordance with a second pump performance graph. The changeover between the two control units 33, 35 takes place by means of a control unit 37, described in further detail in conjunction with FIG. 5 in processing a logic circuit, which control unit compares the temperature and the required fuel quantity or the desired power to be output, as input variables, with fixed limit values and from the comparison forms a simple plus or minus (±) output signal.

The fuel injection pump according to the invention functions as follows.

During the intake stroke of the pump piston 1 in the direction of bottom dead center, the fuel flows out of the low-pressure chamber into the pump work chamber 9 via the control opening 11 uncovered by the face end 7 of the pump piston 1. In the ensuing supply stroke in the direction of top dead center, a small portion of the fuel located in the pump work chamber 7 first flows back into the low-pressure chamber via the control opening 11, until the upper control edge 19 has overtaken the upper control edge 10 of the control opening 11 and the pump piston with its jacket face closes the control opening 11. As the pump piston stroke continues, the fuel located in the pump work chamber 9 is compressed, reaches the injection pressure, and flows via an injection line, not shown, and an injection valve for injection into the combustion chamber of the engine to be supplied. As the oblique control edge 15 overtakes the lower control edge 12 of the control opening 11, the communication between the pump work chamber 9, which is at high pressure, and the low-pressure chamber is opened, so that the high pressure in the pump work chamber 9 decreases and the fuel flows via the control opening 11 into the low-pressure chamber. The pressure in the injection system drops back below the necessary injection pressure, and the injection valve closes.

The instant of closure and opening of the control opening 11 and hence the onset and duration of fuel supply and the injected fuel quantity are controllable by the rotation of the pump piston 1.

A very early injection onset, as required in operation of the cold engine at low load in order to avert the development of white smoke, can be attained via the set position of the region A of the first control edge 19 of the pump piston 1 (pump performance graph 2).

Figure 3:
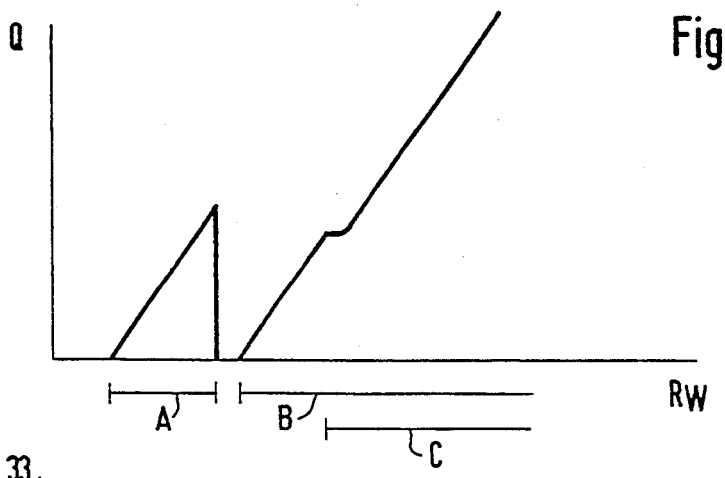
FIG. 3 is a diagram of the supply quantity over the governing path of the fuel injection pump of the invention.

Since such an early supply onset, when the engine is operationally warm or at high load, in other words a high fuel supply quantity, would sharply increase pollutant development and above all $NO_x$ emissions, for this operating range the region B (pump performance graph 1) of the control edge 23 is provided, in which the injection onset is shifted to late by the setback of the control edge 23. In order to have an exact separation between the regions A and B, the longitudinal groove 17 is disposed between them, so that the supply quantity characteristic shown in the diagram of FIG. 3 results over the governing path. It can be seen that the supply quantity Q initially increases with an adjustment of the governor rod or governing mechanism (RW governing path) in the direction of full load, and then is very briefly interrupted, and thereafter rises again steadily in the known manner. The readjustment of the injection onset in the direction of late caused by the region C then has no substantial influence on the supply quantity characteristic, since the slope of the oblique control edge 15 is relatively high compared with the shoulder, so that only a slight kink in the characteristic curve results.

The region C having the control edge 25, created by an additional indentation, is set at higher or full load, and by means of its once-again later supply onset, which can extend into the range of and after top dead center of the piston motion, brings about a reduction in pollutant development and above all in $NO_x$ emissions.

The adjustment of the rotational position of the pump piston 1 relative to the cylinder liner 5 and hence the setting of one of the regions of the control edges 19, 23, 25 in coincidence with the control opening 11, is effected in the exemplary embodiment via an electronic triggering of the drive of the governor rod, whose layout is explained in conjunction with FIGS. 4 and 5.

In FIG. 4, it is assumed that the changeover between the pump performance graphs 2 and 1 or the regions A and B is effected as a function of the engine operating temperature, such as the coolant temperature (T), and the fuel quantity set-point value (desired load), which is demanded via the throttle linkage. the pump performance graph 2 (control unit 35) controls the adjusting motion when the engine is cold and at low load, while the pump performance graph 1 (control unit 33) is employed in the rest of the operating range of the engine.

The block circuit diagram of FIG. 4 shows that the switchover between the pump performance graphs takes place via a logic circuit (control unit 37), which processes the engine operating temperature and its desired load output as input variables; after the setting of one of the pump performance graphs via the rpm governor, a new comparison is made between the actual rpm and the desired load output, and as a result of the comparison the positional governing of the rotational position of the pump piston is performed.

FIG. 5 schematically shows the mode of operation of the logic circuit of the control unit 37, which here functions as an "AND" circuit. By definition, after a comparison of the input values of temperature (T) and load demanded (ME) with fixed limit values, the changeover from the pump performance graph 1 to the pump performance graph 2 is not made unless both drop below the limit values, so that the region A of performance graph 2, with its extreme shift toward early of the injection onset, comes into action only at low temperature and low load, while if only one input value exceeds the limit value a switch back to the pump performance graph 1 already takes place.

In order to avoid repeated changeovers in limit regions, the changeover may be done as a function of hysteresis, as shown in FIG. 5, in which both for the temperature and the load, a limit value band is indicated with an upper (T1, M1) and lower hysteresis limit, where no signals for adjustment are sent to the outside if there are changes in the actual value, and the corresponding signal (±) is output only if the upper or lower limit value is exceeded, and as a function of the output range. Alternatively, it is possible here to perform the temperature-dependent changeover via a time hysteresis, in which the changeover takes place not until a certain temperature value is exceeded or fails to be attained for a certain time.

With the fuel injection pump according to the invention it is accordingly possible, without external injection timers or additional components, to perform a shift toward early at zero or low load as a function of temperature and load and thus to avert the development of white smoke and this operating state of the engine to be supplied.

We claim:

1. A fuel injection pump for internal combustion engines, having a pump piston (1) driven axially back and forth and rotatable in a cylinder bore (3) of a cylinder liner (5), which piston with one end face (7) defines a pump work chamber (9) with said cylinder liner and on its jacket face has a control recess (13) communicating with the pump work chamber (9), which recess has an oblique control edge (15) and cooperates with a control opening (11) in the wall of the cylinder liner (5), which control opening begins at a low-pressure chamber, wherein one edge of the face end (7) of the pump piston (1) toward the pump work chamber forms, toward the pump piston jacket face, a further first control edge (19) cooperating with the control opening (11), which control edge (19) has a region (B), which is indented in a longitudinal direction of the piston toward the drive side of the pump piston (1) and forms a second control edge (23), in which the second control edge (23) is defined circumferentially on one side by a longitudinal groove (17), and a second region (C), indented toward the drive side of the pump piston (1), begins at said second control edge (23), forming a third control edge (25).

2. A fuel injection pump as defined by claim 1, in which the transition between the second control edge (23) and the third control edge (25) is effected by axially parallel edges, forming a shoulder (21) of the second indented region (C).

3. A fuel injection pump as defined by claim 1, in which the adjustment of the rotational position of the pump piston (1) relative to the cylinder liner (5), and hence the coming into operation of the various control edges (19, 23, 25) of the pump piston (1) at the control opening (11), is effected as a function of the load or supply quantity and of the operating temperature of the engine to be supplied.

4. A fuel injection pump as defined by claim 1, in which for the first control edge (19), a pump performance graph 2 is provided for operation of the cold engine at low or zero load, and for the second and third control edge (23, 25), which are separated from the first control edge (19) by the longitudinal groove (19), a pump performance graph 1 is provided for the remaining operating range of the engine.

5. A fuel injection pump as defined by claim 3, in which the changeover between the performance graphs 1 and 2 is controlled via a logic circuit, which processes the temperature of the engine and the demanded fuel quantity, taking a changeover delay into account.

6. A fuel injection pump as defined by claim 4, in which the changeover between the performance graphs 1 and 2 is controlled via a logic circuit, which processes the temperature of the engine and the demanded fuel quantity, taking a changeover delay into account.

7. A fuel injection pump as defined by claim 5, in which the changeover from pump performance graph 1 to pump performance graph 2 is effected via an AND circuit, in which the input variables drop below a predetermined limit value.

8. A fuel injection pump as defined by claim 6, in which the changeover from pump performance graph 1 to pump performance graph 2 is effected via an AND circuit, in which the input variables drop below a predetermined limit value.

9. A fuel injection pump as defined by claim 1, in which the control edges (19, 23, 25) are located in radial planes to the pump piston axis.

10. A fuel injection pump as defined by claim 2, in which the control edges (19, 23, 25) are located in radial planes to the pump piston axis.

11. A fuel injection pump as defined by claim 3, in which the control edges (19, 23, 25) are located in radial planes to the pump piston axis.

12. A fuel injection pump as defined by claim 4, in which the control edges (19, 23, 25) are located in radial planes to the pump piston axis.

13. A fuel injection pump as defined by claim 5, in which the control edges (19, 23, 25) are located in radial planes to the pump piston axis.

14. A fuel injection pump as defined by claim 6, in which the control edges (19, 23, 25) are located in radial planes to the pump piston axis.

15. A fuel injection pump as defined by claim 7, in which the control edges (19, 23, 25) are located in radial planes to the pump piston axis.

16. A fuel injection pump as defined by claim 8, in which the control edges (19, 23, 25) are located in radial planes to the pump piston axis.

* * * * *